US005282625A

United States Patent [19]

Schmidt et al.

[11] Patent Number: 5,282,625

[45] Date of Patent: Feb. 1, 1994

[54] IRON GOLF CLUB HEAD WITH DUAL INTERSECTING RECESSES

[75] Inventors: Glenn H. Schmidt; Richard C. Helmstetter, both of Carlsbad, Calif.

[73] Assignee: Callaway Golf Company, Carlsbad, Calif.

[21] Appl. No.: 921,857

[22] Filed: Aug. 5, 1992

[51] Int. Cl.[5] ..... A63B 53/04

[52] U.S. Cl. ..... 273/167 H; 273/167 F; 273/169

[58] Field of Search ..... 273/77 R, 77 A, 78, 273/169, 171, 172, 173, 167 A, 167 E, 167 F-K

[56] References Cited

U.S. PATENT DOCUMENTS

| | | | |
|---|---|---|---|
| D. 228,355 | 9/1975 | Penna | D21/220 |
| D. 234,963 | 4/1975 | Kirata | D21/220 |
| D. 247,383 | 2/1978 | Adkins | 273/167 F |
| D. 303,132 | 8/1989 | Muta | D21/220 |
| D. 321,920 | 11/1991 | Parente et al. | D21/220 |
| 1,854,548 | 4/1932 | Hunt | 273/78 |
| 1,993,928 | 3/1935 | Glover | 273/169 |
| 2,231,847 | 2/1941 | Dickson et al. | 273/80.8 |
| 3,068,011 | 12/1962 | Sano . | |
| 3,199,872 | 8/1965 | Taylor . | |
| 3,847,399 | 11/1974 | Raymont | 273/167 F |
| 4,398,965 | 8/1983 | Campau | 273/78 |
| 4,632,400 | 12/1986 | Boone | 273/169 |
| 4,653,756 | 3/1987 | Sato | 273/169 |
| 4,715,601 | 12/1987 | Lamanna | 273/169 |
| 4,740,345 | 4/1988 | Nagasaki | 273/169 |
| 4,848,747 | 7/1989 | Fujimura et al. | 273/77 A |
| 4,854,581 | 8/1989 | Long | 273/77 A |
| 4,884,812 | 12/1989 | Nagasaki et al. | 273/167 H |
| 4,913,435 | 4/1990 | Kobayashi | 273/77 A |
| 4,928,972 | 5/1990 | Nakanishi et al. | 273/78 |
| 4,957,294 | 9/1990 | Long | 273/169 |
| 4,964,640 | 10/1990 | Nakanishi et al. | 273/167 H |
| 4,986,541 | 1/1991 | Teramoto et al. | 273/77 A |
| 4,995,609 | 2/1991 | Parente et al. | 273/80.2 |
| 5,026,056 | 6/1991 | Medally et al. | 273/169 |
| 5,046,733 | 9/1991 | Antonious | 273/169 |
| 5,067,711 | 11/1992 | Parente et al. | 273/77 A |

FOREIGN PATENT DOCUMENTS 371974 3/1932 United Kingdom .

OTHER PUBLICATIONS

"Some of Our Best Friends are Hookers and Pushers", Golf World, Jan. 1974, p. 45.

"The Ounce That Counts", Golf World, Jan. 24, 1975, pp. 46 and 47.

"Stroke-Savers," Golf Digest, Mar. 1988, pp. 82 and 83.

"FTD Iron by First Flight", Golf World, May 23, 1972, p. 10.

"The Wilson Staff Dynapower Iron", Time Magazine, Mar. 24, 1967, p. 1.

"T.P. Super Blade", Golf World, Jun. 13, 1972, p. 25.

*Primary Examiner*—V. Millin

*Assistant Examiner*—Steven B. Wong

*Attorney, Agent, or Firm*—William W. Haefliger

[57] ABSTRACT

A golf club head having a body defining a heel, toe, top wall, sole and a front wall defining an upwardly and rearwardly inclined front face comprising the body defining a forwardly extending main recess located rearwardly of the front wall; and the body also defining an undercut recess located directly rearwardly of the front wall and extending outwardly from the main recess toward at least three of the following:

i) the top wall ii) the bottom wall iii) the toe iv) the heel.

25 Claims, 8 Drawing Sheets

FIG. 18.
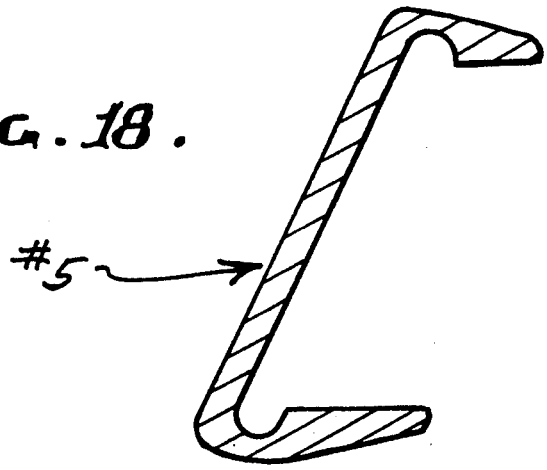
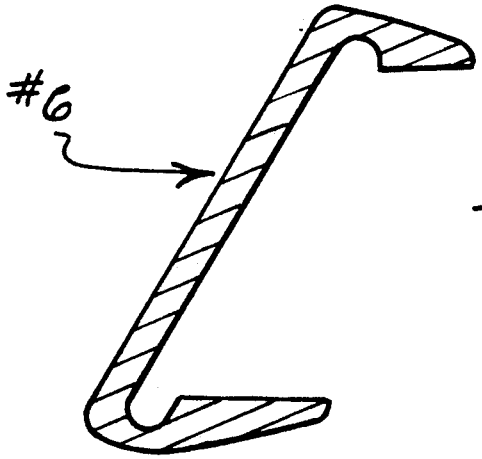
FIG. 19.
FIG. 20.
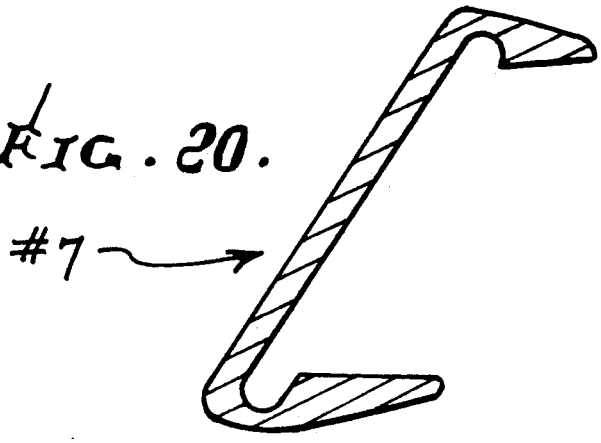

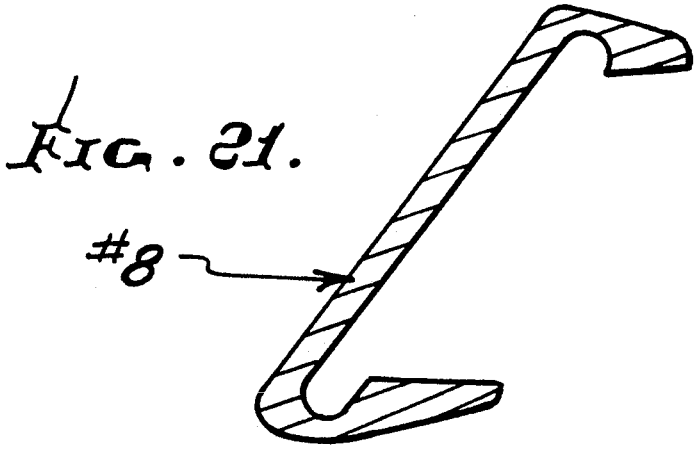
FIG. 21.
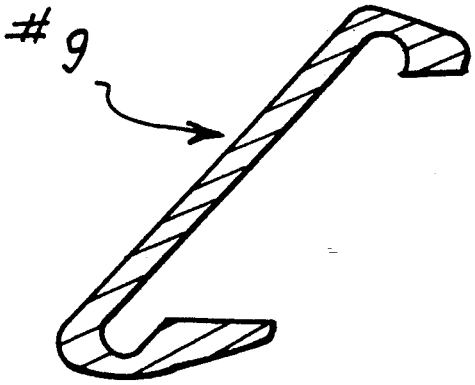
FIG. 22.
FIG. 23.
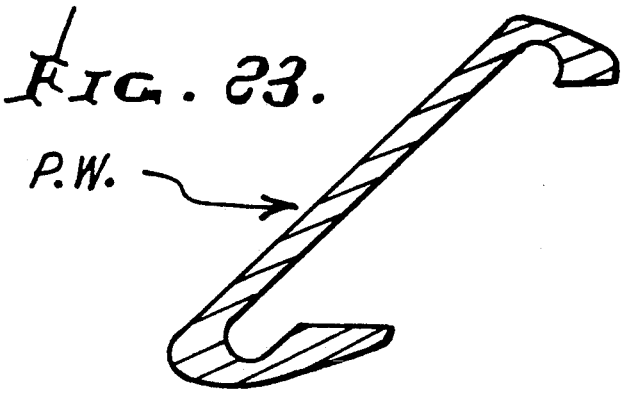

IRON GOLF CLUB HEAD WITH DUAL INTERSECTING RECESSES

BACKGROUND OF THE INVENTION

This invention relates generally to golf clubs, and more particularly to golf club irons of improved construction to achieve advantages, such as twist resistance, during impact with golf balls, and delayed momentum transfer to golf balls during stroking. In this regard, and in the past, irons evolved in design from flat back to hollow back structure, the present invention providing a further evolution in back structure to achieve virtual head enlargement effects.

Many efforts have been made to design iron heads to achieve higher energy availability for transfer to the golf ball when the ball is impacted by the head. However, no way was known, to our knowledge, to achieve delayed momentum transfer to the ball, over the very short time interval when the ball remains in contact with the head face, in the novel and unusual manner as achieved by the present invention; and no way was known to couple such delayed energy transfer with head twist resistance, in the manner to be described.

SUMMARY OF THE INVENTION

It is a major object of the invention to provide an improved iron head construction meeting the need for delayed momentum transfer to the ball during club stroking, and also to provide club head increased twist resistance. Basically, the invention as embodied in a head metallic body, is constructed to define two intersecting recesses rearwardly of the head front wall, and bounded by head metallic extents projecting rearwardly proximate peripheral regions of the head face defining front wall. For example, the head may include:

a) a body defining a forwardly extending main recess located rearwardly of the front wall, b) and the body also defining an undercut recess located directly rearwardly of the front wall and extending outwardly from the main recess toward at least three of the following:

i) the top wall ii) the bottom wall iii) the toe iv) the heel.

As will be seen, the undercut recess may extend outwardly from its intersection with the main recess toward all of the top and bottom walls, and the toe and heel, whereby the undercut recess may then bound the main recess. This construction facilitates slightly delayed forward transfer of momentum of the body metal rearwardly of the undercut recess, to the front wall and front face, via peripheral extents of the head. Typically, the metal of the head has reduced thickness directly rearwardly of the front wall periphery, due to the provision of the undercut recess, as referred to. This also enables reallocation of some metal to project rearwardly from the looping recess, enhancing head peripheral weighting for anti-twist effect.

Another objective is to provide an undercut recess, as referred to, which extends in a loop that lies generally parallel to the inclined front face of the iron. The inclination of that loop varies with the number of the iron, designating different front face inclinations, as for example 1 to 9 irons and wedges.

A further object is to provide the head with a rearward projection with upward thickening between the bottom wall and the main recess, and rearwardly of the undercut recess that extends toward the bottom wall; and the head may also have a rearward projection with downward thickening between the top wall and the main recess, and rearwardly of the undercut recess that extends toward the top wall.

Yet another object is to provide a set of irons, each iron incorporating the dual intersecting recesses, as referred to, and the rearward projections extending generally horizontally irrespective of the angles of the front faces of the irons in the set.

These and other objects and advantages of the invention, as well as the details of illustrative embodiments, will be more fully understood from the following specification and drawings, in which:

DRAWING DESCRIPTION

FIGS. 15-22 are sections like FIG. 8 but showing a sequence of head cross sections from a #2 iron to a #9 iron; and FIG. 23 is a section like FIG. 22 but showing a pitching wedge cross section.

DETAILED DESCRIPTION

Figure 1:
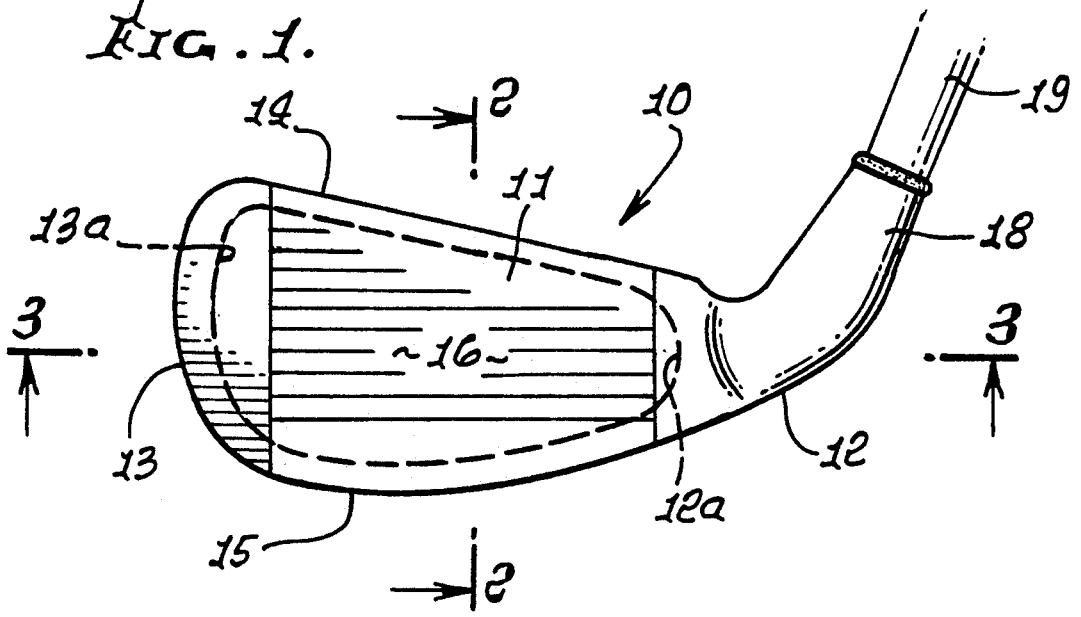
FIG. 1 is a frontal elevation of a #1 iron of a golf club set incorporating the invention.

Referring first to FIG. 1, the illustrated golf club head 10, in the form of a #1 iron of a set, has a body 11 defining a heel 12, toe 13, top wall 14, and sole 15. The body also defines an upwardly and rearwardly inclined front face 16 at the frontal side of an associated front wall 17. A hosel is shown at 18 and integrally joins the body; and a shaft 19 extends into and through the hosel as shown, and is anchored therein in a suitable manner. The head and hosel may consist of a one-piece, metallic, steel casting, other metals and alloys being usable.

In accordance with the invention, the body defines two intersecting recesses related to rearwardly elongated body projections, typically extending rearwardly, as will be described, irrespective of the head front face angularity. The two recesses include a forwardly and rearwardly extending main recess 21, and an undercut recess 22 located directly rearwardly of the front wall and extending outwardly from the forwardmost extent of the main recess 21, toward at least three of the following:

i) a top wall 14 ii) a bottom wall or sole 15 iii) the toe region 13 iv) the heel region 12. Typically, the undercut recess portions 14*a* and 15*a*, associated with walls 14 and 15, are elongated directionally between the toe and heel, over the major length of the head, thereby achieving a large portion of the benefits of the invention. These benefits include metal redistribution toward the upper and lower peripheries of the head, and projecting rearwardly at 24 and 25, for enhancing anti-twist of the head during stroking and ball impact. Such metal rearwardly redistribution, i.e., lengthening in a rearwardly and functionally outwardly (enlarging effect) direction, as at 24 and 25, rearwardly of undercuts 14*a* and 15*a*, is believed to achieve somewhat delayed momentum transfer from the metal portions 24 and 25, to the front wall and front face 16, thereby maintaining a greater time interval of front face contact with the ball during stroking, for better ball control.

Note that such momentum transfer, visualized in the form of forward waves, is required to pass around and through the reduced thickness forward portions 14*b* and 15*b* of the rearwardly projecting portions 24 and 25, enhancing such delay. Such delay of wave travel through narrowed regions 14*b* and 15*b* is facilitated by the outwardly concave curvature at 14*c* and 15*c*, or other similar thickness narrowing shape, bounding the outermost extents of the undercuts 14*a* and 15*a*. Regions 14*b* and 15*b* may be regarded as webs. Enhanced performance and ball control have been determined by repeated, actual use of such an iron, both with humans and robots.

The undercut recess portions 12*a* and 13*a*, associated with the heel and toe, and associated metal redistribution rearwardly and functionally outwardly (i.e., enlarging effect) from those undercuts, contribute to and add to the same effects as described above for the undercut recess portions 14*a* and 15*a*. The undercut recess projects outwardly to an extent $w_1$ (which may vary, as shown); however, the front-to-rear thickness $t_1$ of the undercut recess is approximately as follows:

$$0.5t_1 < w_1 < 1.5t_1$$

The radius of the circular curvatures at 14*c* and 15*c* are typically between 0.150 and 0.160 inches for #1 through #7 irons; between 0.210 and 0.230 for #8 and #9 irons; and between 0.300 and 0.320 for a pitching wedge; however, these dimensions can vary.

Figure 3:
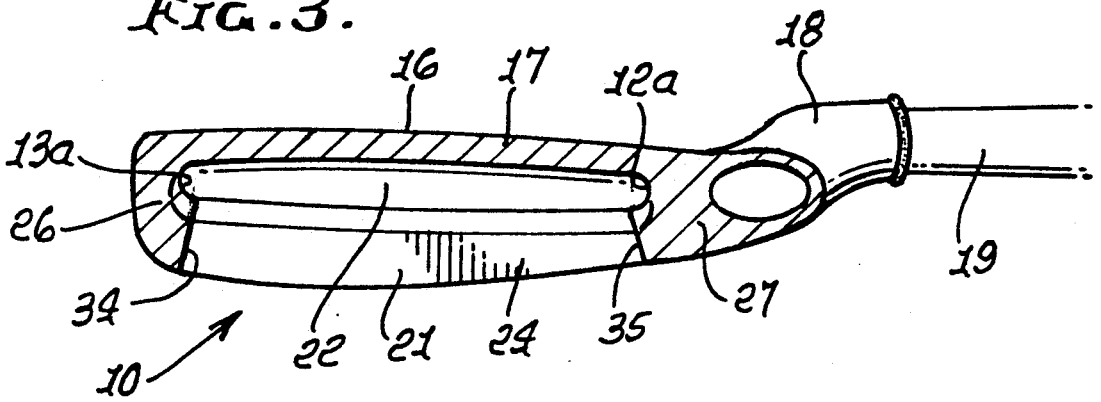
FIG. 3 is a horizontal section on lines 3—3 of FIG. 1.

Note in this regard the rearward projections 26 and 27 in FIG. 3, extending rearwardly from the undercuts 12*a* and 13*a*. Such rearward projections 24 and 25, 26 and 27, are rearwardly elongated in relation to their thickness dimensions showing that metal has been redistributed to those projections to enhance the effects described and without increasing the overall vertical dimension of the head.

Note also that the dimension of the recess 21, between corners 29 and 30, is at least about three times greater than the depth dimension of each of the undercut recess portions 14*a* and 15*a*, in an outward direction from those corners. The inner sides 32 and 33 of the projections 24 and 25 are substantially flat in a forward to rearward direction; however, they define a loop in combination with the corresponding inner and curved sides 34 and 35 of the projections 26 and 27, that loop subtending the major aerial extent of the front face, including a "sweet spot". Correspondingly, all undercut sections 14*a* and 15*a*, 26*a* and 27*a*, also define, preferably, a loop.

Figure 13:
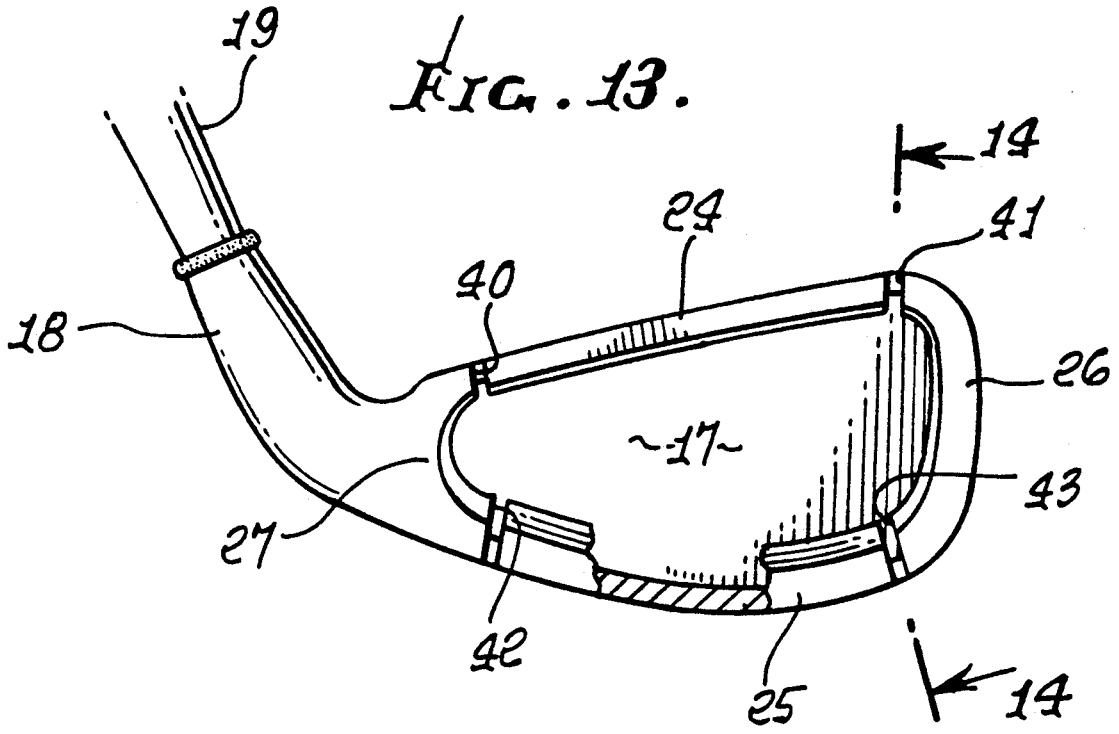
FIG. 13 is a rear view of a head, like that of FIGS. 1-3, but showing slots extending rearwardly from the undercut recess at different positions along the looping length of that recess.
Figure 14:
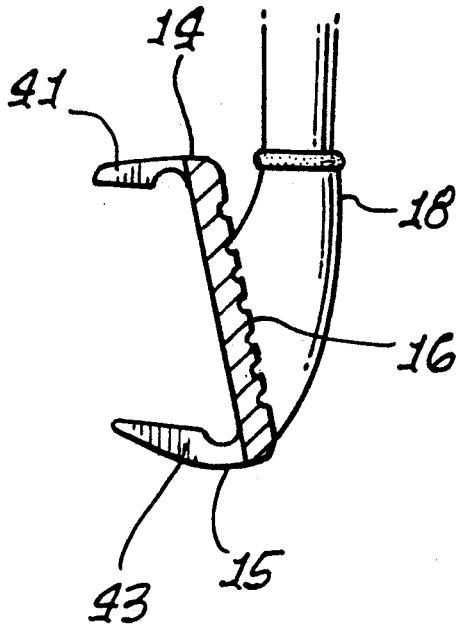
FIG. 14 is a section taken on lines 14—14 of FIG. 13.

FIG. 13 shows that slots may be provided, as at 40–43, proximate corners of the loop defined by the rearward projections 24–27 to decouple or reduce the stiffening effect of joining the rearward extending portions 24–27 at the loop corners. This allows the momentum transfer from each of such portions to proceed forwardly with delayed action, as referred to without being affected by the momentum transfer associated with the other portions, or attenuated by the effects of such other portions.

Figure 4:
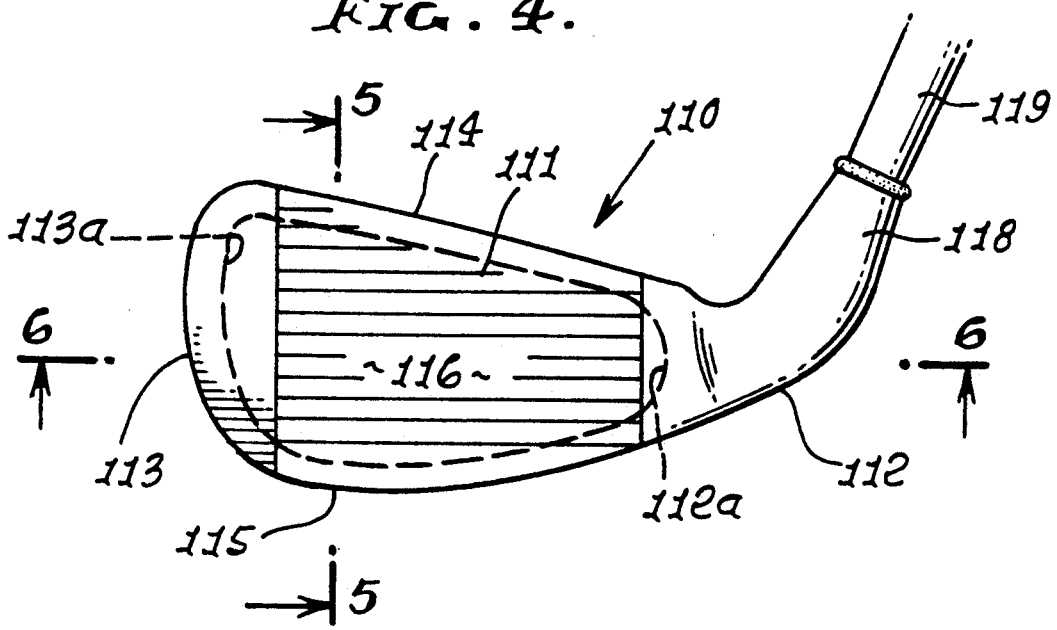
FIG. 4 is a view like FIG. 1 but showing a #6 iron incorporating the invention.
Figure 5:
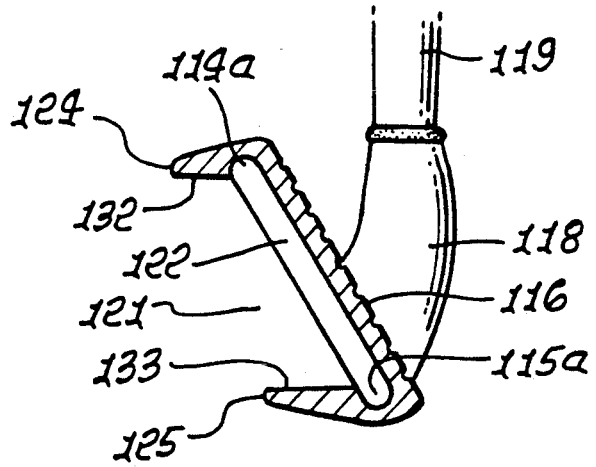
FIG. 5 is a section taken on lines 5—5 of FIG. 1.
Figure 6:
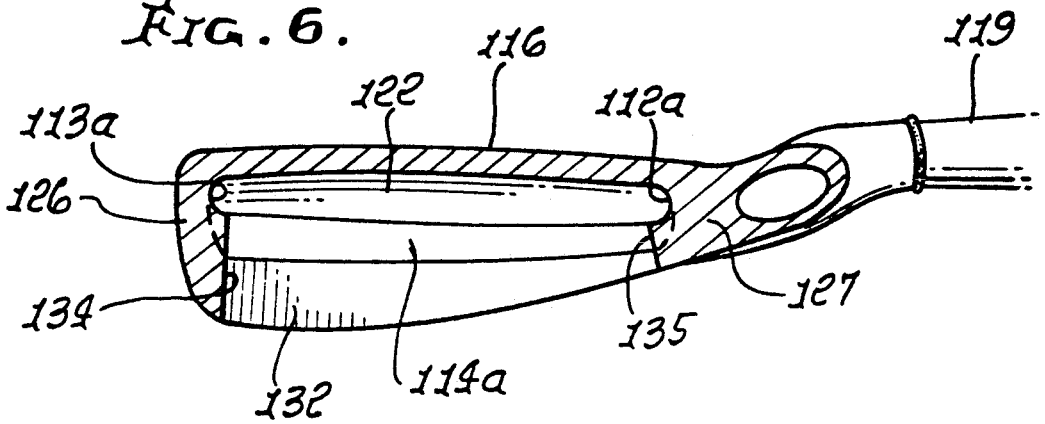
FIG. 6 is a horizontal section on lines 6—6 of FIG. 4.

FIGS. 4–6 show a corresponding construction of a #6 iron, having a more inclined front face, as shown. The corresponding numbered elements are the same as those in FIGS. 1–3, with each number preceded by a 1, i.e., providing a one hundred series of numbers.

Figure 2:
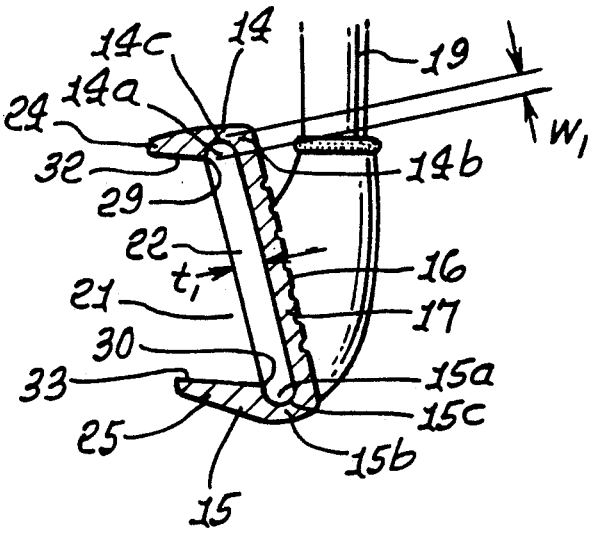
FIG. 2 is a section taken on lines 2—2 of FIG. 1.
Figure 7:
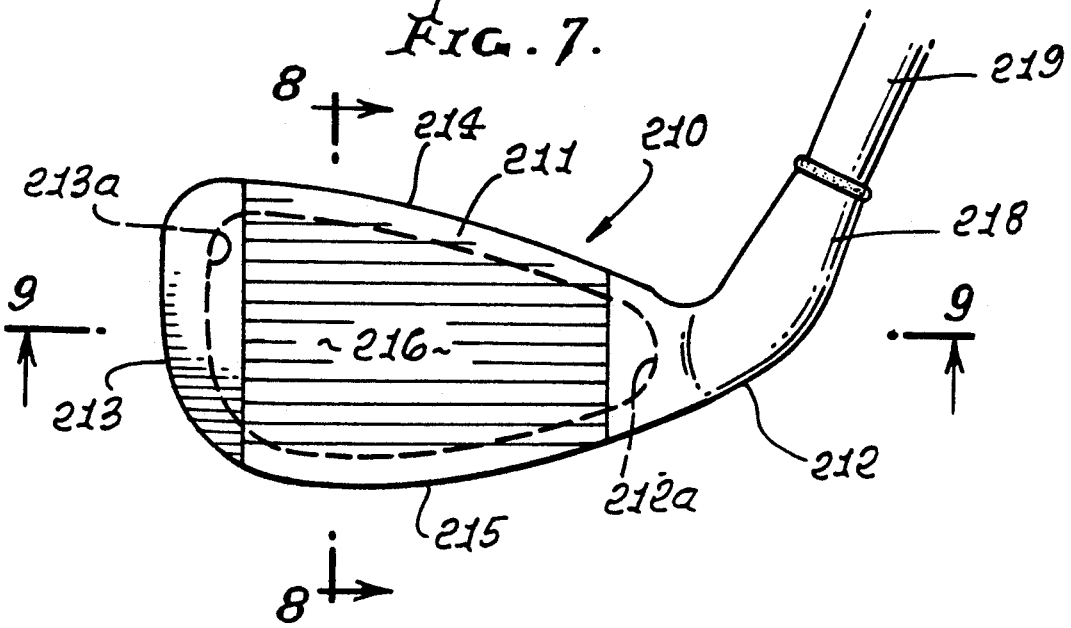
FIG. 7 is a view like FIG. 1 showing a #8 iron incorporating the invention.
Figure 8:
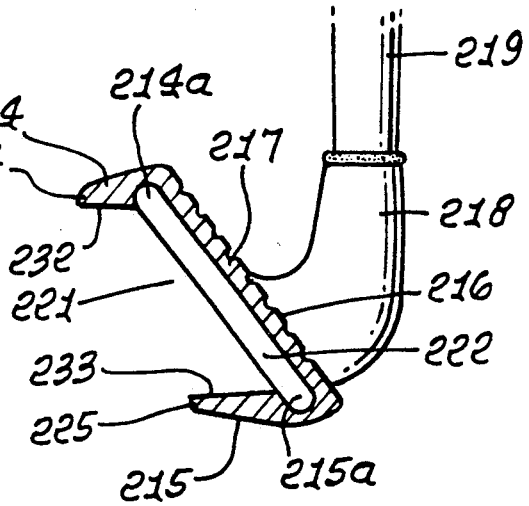
FIG. 8 is a vertical section taken on lines 8—8 of FIG. 7.
Figure 9:
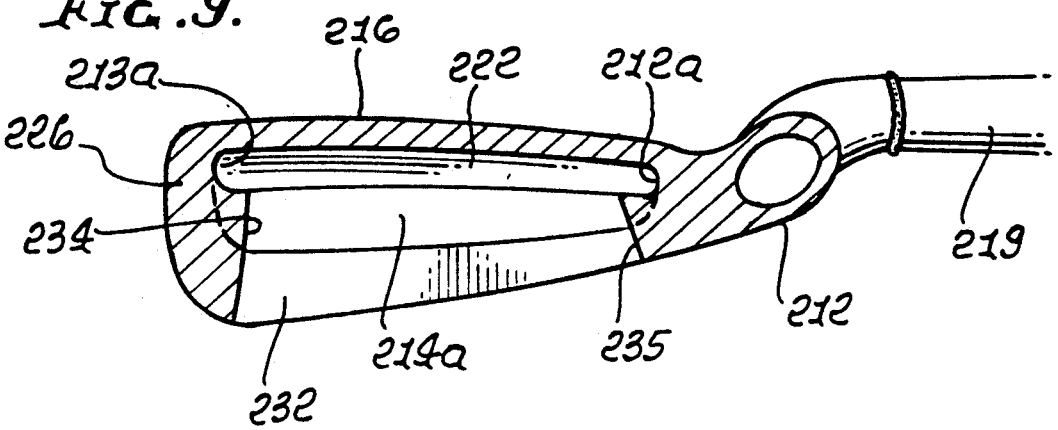
FIG. 9 is a horizontal section taken on lines 9—9 of FIG. 7.

FIGS. 7–9 correspond to FIGS. 1–3, but show a #8 iron with the two recesses in associated structure, as defined above. The corresponding elements have a 2 preceding each number, whereby a two hundred series of elements is defined.

Figure 10:
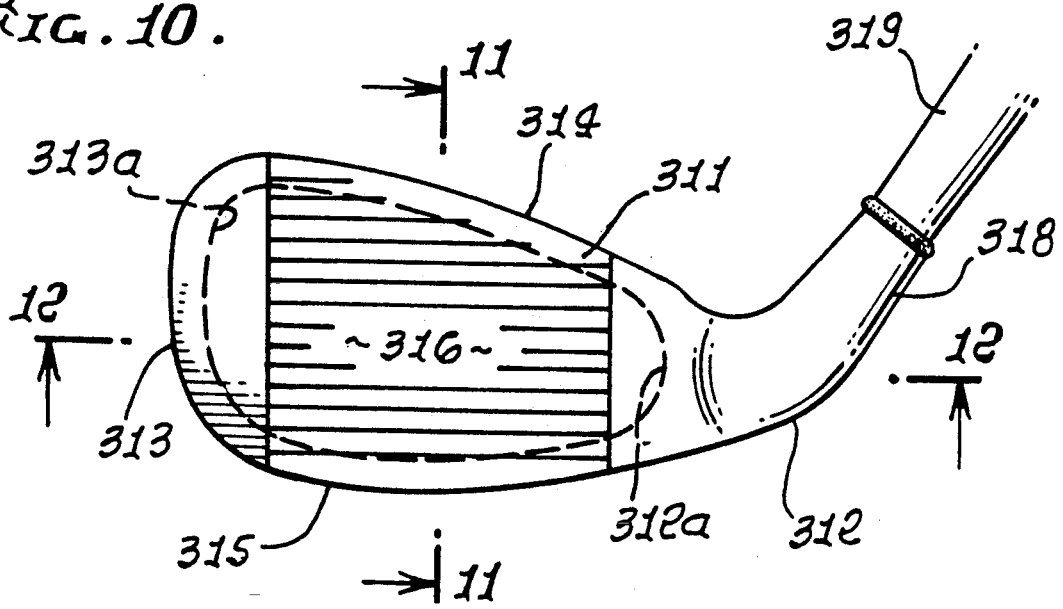
FIG. 10 is a view like FIG. 1 showing a pitching wedge incorporating the invention.
Figure 11:
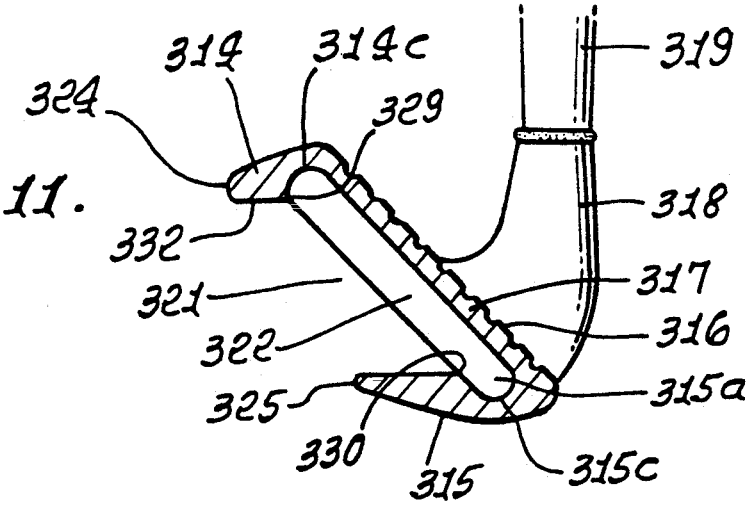
FIG. 11 is a section taken on lines 11—11 of FIG. 10.
Figure 12:
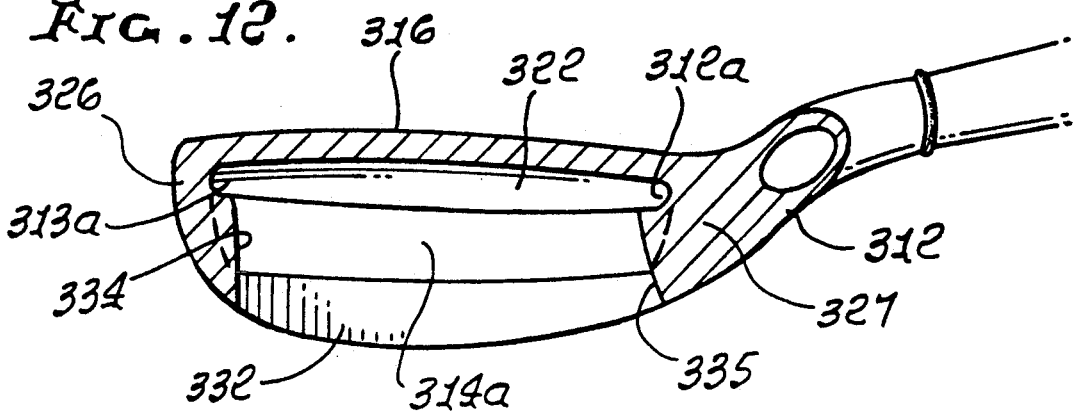
FIG. 12 is a section taken on lines 12—12 of FIG. 10.

FIGS. 10–12 correspond to FIGS. 1–3, but show a pitching wedge with the two recesses in associated structure, as defined above. The corresponding elements have a 3 preceding each number, whereby a three hundred series of elements is defined.

It will be understood that intermediate irons have the same construction, as in FIGS. 15–23, but with associated changing front face inclinations, as in a set of such irons. Accordingly, each iron of the set has the invention incorporated therein. FIGS. 15–23 are vertical sections taken at about the location of section 5—5 of FIG. 4.

Figure 15:
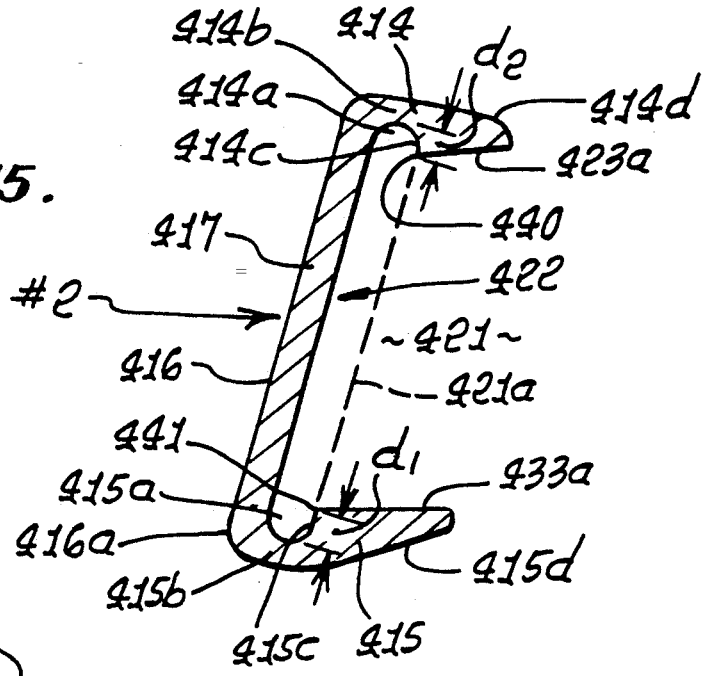

In FIG. 15, the main recess is shown at 421, and the undercut recess is indicated at 422, intersecting 421 at its forwardmost extent. See broken line 421*a*. The undercut recess extent into the top wall 414 is indicated at 414*a*; and the undercut recess into the bottom wall 415 is indicated at 415*a*. The depth of 415*a* is indicated at $d_1$, and the depth of the recess 414*a* is indicated at $d_2$, $d_1$ always being greater than $d_2$. This is also true for the irons of the set shown in FIGS. 16–23; and the minimum thickness of the narrowed region 414*b* is approximately the same as the minimum thickness of the bottom wall at 415*b*. For example, these thicknesses may be between 0.075 and 0.085 inches in typical clubs. The rearward slanting, or loft, of the undercut recess in the succession of heads of FIGS. 15–23 increases, as shown, in correspondence to the increasing rearward sloping of the head front walls, such a wall being shown at 417 in FIG. 15. The ball-striking face is indicated at 416. Depth $d_1$ extends below the upper level of front face downward curvature at 416*a*.

Also note in FIGS. 15–23 the sharp, edged corners, as in FIG. 15 at 440 and 441, these being defined by the intersection of the concave surface 414*c* and flat ledge 432*a*; and the concave surface 415*c* and the flat ledge 433*a*.

Referring again to the depth $d_1$ of the undercut 414*a* nearest the toe, that depth gradually diminishes upwardly from 415*a* along the undercut length closest to the toe end of the head until it equals the depth $d_2$ at the point where the undercut 414*a* meets the undercut 414*a* at the toe end of the club. The same gradient depth dimensioning exists at the undercut extent closest the heel. This is true for each of the heads shown in FIGS. 15–23.

Finally, the curvatures at 414*c* and 415*c* are circular, or approximately circular, as shown in each of the FIGS. 15–23; however, such curvatures may vary so long as a gradually narrowed and gradually expanded bottom and top wall thickness at 415*a* and 414*b*, respectively, is or are formed to facilitate a gradual pinch or "Bernoulli" effect, as respects achievement of delayed momentum wave transfer forwardly, as previously described. Note also upward and rearward inclination of bottom wall 415 surface at 415*d*; and downward and rearward inclination of top wall 414 surface at 414*d*.

All of these features, as described in connection with FIGS. 15–23, contribute to the unusual advantages of the invention, as referred to herein.

Figure 16:
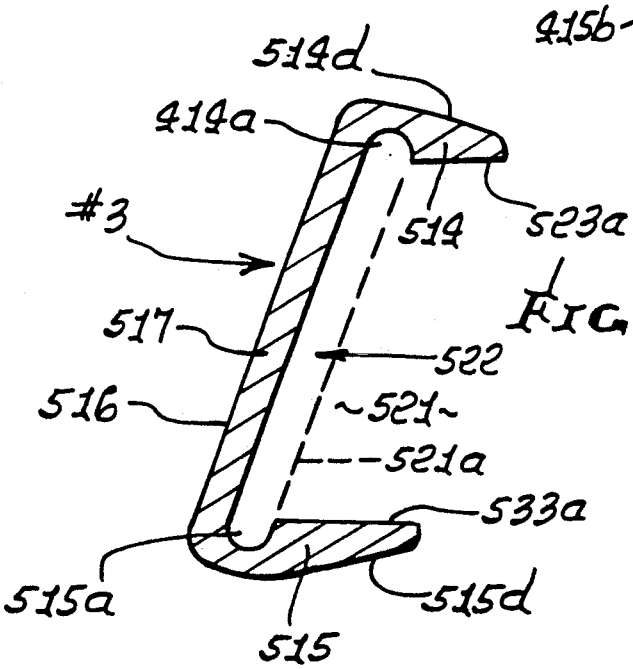
Figure 17:
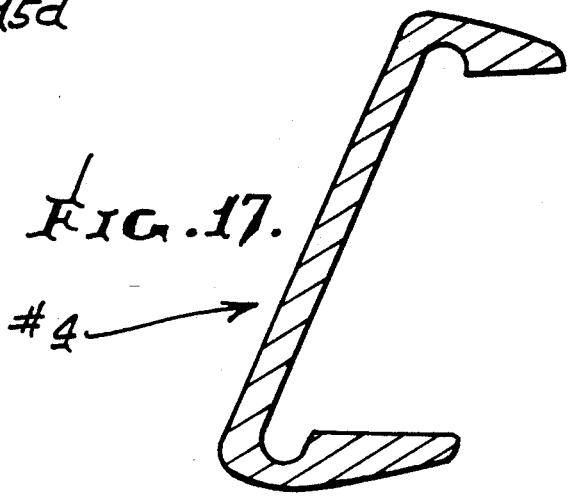

In FIG. 16, corresponding elements are the same as in FIG. 15, but commence with the number 5. See also the remaining views, FIGS. 17–23.

We claim:

1. A golf club head having a body defining a heel, toe, top wall, bottom wall, a sole and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least said top wall and said bottom wall, c) each of said top and bottom walls having a maximum vertical thickness region rearwardly of and adjacent said undercut recess, said top wall tapering rearwardly and being rearwardly elongated rearwardly of said undercut recess and rearwardly of said top wall maximum vertical thickness region to overlie said main recess, and said bottom wall tapering rearwardly and being rearwardly elongated rearwardly of said undercut recess, and rearwardly of said bottom wall maximum vertical thickness region to underlie said main recess, said top wall defining a reduced thickness web in relation to said front wall adjacent to and above said undercut recess, said web located rearwardly of the top level of said front face, and said undercut recess nearest said web extending upwardly to a level proximate said top level of said front face, d) said undercut recess extending into said top and bottom walls proximate the top level of said front face, and proximate the bottom level of said front face, respectively.

2. The golf club head of claim 1 wherein said undercut recess also extends outwardly from said main recess and adjacent said front wall toward at least one the following:

i) said toe ii) said heel.

3. The club head of claim 1 wherein said undercut recess also extends outwardly from said main recess and adjacent said front wall toward said toe and said heel, said undercut recess being free of filler backing material.

4. The golf club head of claim 1 wherein said bottom wall has relatively reduced thickness to form a web below said undercut recess.

5. The golf club head of claim 4 wherein said undercut recess extends in a loop that is generally parallel to the inclined front face.

6. The golf club head of claim 4 wherein said undercut recess extends outwardly toward said top wall and toward said bottom wall, the depth of the undercut recess toward said top wall being lesser than the depth of said undercut recess toward said bottom wall.

7. The golf club head of claim 6 wherein said undercut recess toward said top wall has a substantially circular cross section adjacent said top wall, and said undercut recess toward said bottom wall has a substantially circular cross section adjacent said bottom wall.

8. The golf club head of claim 6 wherein said undercut recess proximate said heel and proximate the toe decreases gradually in depth in an upward direction.

9. The golf club head of claim 1 wherein said bottom wall has rearward projection rearwardly of said undercut recess that extends toward said bottom wall.

10. The golf club head of claim 9 wherein said top wall has rearward projection rearwardly of said undercut recess that extends toward said top wall.

11. The golf club head of claim 9 wherein said rearward projection from the undercut recess has substantially greater overall rearward dimension than vertical thickness dimension.

12. The golf club head of claim 1 wherein said top wall has rearward projection rearwardly of said undercut recess that extends toward said top wall.

13. The golf club head of claim 12 wherein said rearward projection from the undercut recess has substantially greater overall rearward dimension than vertical thickness dimension.

14. The golf club head of claim 1 wherein said body is metallic.

15. The golf club head of claim 14 wherein said body is a one-piece casting, and defines an iron golf club head.

16. The golf club of claim 1 wherein said body consists of a metallic casting.

17. The club head of claim 1 wherein said undercut recess projects outwardly to an extent $w_1$, and has front to rear thickness $t_1$, where $0.5t_1 < w_1 < 1.5t_1$.

18. The golf club head of claim 1 wherein said body has at least one slit extending rearwardly from said undercut recess and extending outwardly from said main recess.

19. A golf club head having a body defining a heel, toe, top wall, sole and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least three of the following:

i) said top wall ii) said bottom wall iii) said toe iv) said heel, c) and wherein said body has four slits extending rearwardly from said undercut recess and extending outwardly from said main recess at the following locations:

proximate the junction of the heel and top wall proximate the junction of the heel and bottom wall proximate the junction of the toe and top wall proximate the junction of the toe and bottom wall.

20. A golf club head having a body defining a heel, toe, top wall, sole and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward the following:

i) said top wall ii) said bottom wall, said undercut recess proximate said top wall having lesser depth than said undercut recess proximate said bottom wall, c) and wherein said top wall has reduced vertical thickness in relation to said front wall outwardly of said undercut recess extending toward the top wall, said bottom wall has reduced vertical thickness in relation to said front wall outwardly of said undercut recess extending toward said bottom wall, and said two reduced thicknesses define webs, rearwardly of the uppermost and lowermost levels of said front face, d) said undercut recess extending into said top and bottom walls proximate the top level of said front face, and proximate the bottom level of said front face, respectively.

21. The golf club head of claim 20 wherein said minimum thicknesses are between 0.075 and 0.085 inches.

22. Multiple golf club heads in a set, each head having a body defining a heel, toe, top wall, bottom wall, sole and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward said top and bottom walls, each of said top and bottom walls having a maximum vertical thickness region rearwardly of and adjacent said recess, said top wall tapering rearwardly and being rearwardly elongated rearwardly of its maximum vertical thickness region to overlie said main recess, said top wall having reduced vertical thickness in relation to said front wall outwardly of said undercut recess, and said bottom wall tapering rearwardly and being rearwardly elongated rearwardly of its maximum vertical thickness region to underlie said main recess, said undercut recess extending into said top and bottom walls proximate the uppermost and lowermost levels respectively of said front face, c) the undercut recesses in said bodies of the set having increasing rearward angularity in correspondence to increasing rearward angularity of the inclined front faces of the bodies of the set, d) said undercut recess in each body extending into said top and bottom walls proximate the top level of said front face, and proximate the bottom level of said front face, respectively.

23. The invention of claim 22 wherein in each of said bodies, the undercut recess projects toward the top wall and toward the bottom wall as defined, the undercut recess projecting toward the top wall having depth less than the undercut recess projecting toward the bottom wall.

24. A golf club head having a heel, toe, top wall, bottom wall, a front wall defining an upwardly and rearwardly inclined front face, and comprising a) said body defining a forwardly extending main recess located rearwardly of said front wall, b) said body also defining an undercut recess located directly rearwardly of said front wall to intersect said main recess, and extending outwardly from said main recess toward and into at least one of said top wall and bottom walls, c) said top wall being rearwardly elongated directly rearwardly of said undercut recess at the level of the top of said front wall, aid top wall having reduced vertical thickness in relation to said front wall outwardly of said undercut recess, thereby to define a web, d) said web located rearwardly of the top level of said front face, and said undercut recess nearest said web extending to a level proximate the top level of said front face.

25. A golf club head having a heel, toe, top wall, bottom wall, a front wall defining an upwardly and rearwardly inclined front face, and comprising a) said body defining a forwardly extending main recess located rearwardly of said front wall, b) said body also defining an undercut recess located directly rearwardly of said front wall to intersect said main recess, and extending outwardly from said main recess toward and into said top and bottom walls, thereby to form upper and lower undercut recesses, c) said top and bottom walls being rearwardly elongated directly rearwardly of said upper and lower undercut recesses, and rearwardly of peripheral extents of said front wall, d) said top wall having reduced vertical thickness in relation to said front wall outwardly of said upper undercut recess to define a web, e) said web located rearwardly of the top level of said front face, and said upper undercut recess nearest said web extending to a level proximate the top level of said front face.

* * * * *